US008663007B2

(12) United States Patent
Kenney et al.

(10) Patent No.: US 8,663,007 B2
(45) Date of Patent: Mar. 4, 2014

(54) CARD GAME PLAYING DEVICE AND METHOD OF PLAYING A GAME

(75) Inventors: Tyler B. Kenney, Redondo Beach, CA (US); Brian M. Yu, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 636 days.

(21) Appl. No.: 12/210,778

(22) Filed: Sep. 15, 2008

(65) Prior Publication Data

US 2009/0096159 A1 Apr. 16, 2009

Related U.S. Application Data

(60) Provisional application No. 60/972,423, filed on Sep. 14, 2007.

(51) Int. Cl.
*A63F 9/24* (2006.01)
*G06F 17/00* (2006.01)

(52) U.S. Cl.
USPC ..... 463/37; 463/7; 463/9; 463/10; 463/11; 463/36; 463/46; 273/138.2; 273/237; 273/292

(58) Field of Classification Search
USPC ..... 463/11
See application file for complete search history.

(56) References Cited

U.S. PATENT DOCUMENTS

| | | | |
|---|---|---|---|
| 1,771,851 | A | 7/1930 | Kaufmann |
| 1,947,067 | A | 2/1934 | Smith |
| 3,195,896 | A | 7/1965 | Markham |
| 3,198,522 | A | 8/1965 | Parks |
| 3,210,081 | A | 10/1965 | Rapaport |
| 3,834,711 | A | 9/1974 | Breslow |
| 3,841,637 | A | 10/1974 | Piazza et al. |
| 3,871,652 | A | 3/1975 | Schreier |
| 4,171,813 | A | 10/1979 | Kuna et al. |
| 4,285,517 | A | 8/1981 | Morrison |
| 4,359,220 | A | 11/1982 | Morrison et al. |
| 4,363,482 | A | 12/1982 | Goldfarb |
| 4,770,416 | A | 9/1988 | Shimizu et al. |
| 4,779,873 | A | 10/1988 | Joergensen |
| 4,842,276 | A | 6/1989 | Darby |
| 4,895,364 | A | 1/1990 | Martel et al. |

(Continued)

FOREIGN PATENT DOCUMENTS

| | | |
|---|---|---|
| DE | 2114414 | 8/1972 |
| DE | 3031269 A1 | 8/1981 |

(Continued)

OTHER PUBLICATIONS

Written Opinion dated Apr. 7, 2009 for International Application No. PCT/US2008/076413 International Filing Date Sep. 15, 2008.

(Continued)

*Primary Examiner* — Werner Garner
(74) *Attorney, Agent, or Firm* — Cantor Colburn LLP

(57) ABSTRACT

A game playing device having a housing with a card holding member, the card holding member being configured to receive a plurality of cards; a plurality of switches located on a surface of the housing each of the plurality of switches being capable of being illuminated; and a controller for selectively illuminating each of the plurality of switches, the illumination of at least one of the plurality of switches indicating a turn for playing the game playing device.

18 Claims, 5 Drawing Sheets

(56) References Cited

U.S. PATENT DOCUMENTS

| | | | | |
|---|---|---|---|---|
| 5,114,153 | A | 5/1992 | Rosenwinkel et al. | |
| 5,366,221 | A | 11/1994 | Schwartz et al. | |
| 5,564,702 | A | 10/1996 | Meffert | |
| 5,573,245 | A | 11/1996 | Weiner et al. | |
| 5,743,796 | A | 4/1998 | Orak et al. | |
| 5,816,576 | A | 10/1998 | Aramapakul et al. | |
| 5,882,011 | A | 3/1999 | Praria | |
| 5,918,881 | A | 7/1999 | Kirby | |
| 6,213,467 | B1 | 4/2001 | Andrews | |
| 6,247,697 | B1 | 6/2001 | Jewett | |
| 6,485,366 | B1 | 11/2002 | Rowe | |
| 6,651,984 | B1 | 11/2003 | Luken | |
| 6,905,122 | B2 | 6/2005 | Weigl et al. | |
| 6,926,274 | B1 | 8/2005 | Portella | |
| 7,017,908 | B1 | 3/2006 | Tan et al. | |
| 7,080,837 | B2 | 7/2006 | Voigt, IV | |
| 7,367,564 | B2 | 5/2008 | Latell | |
| 7,503,564 | B2 | 3/2009 | Weigl | |
| 7,549,921 | B2 | 6/2009 | Storm | |
| 7,677,574 | B1 | 3/2010 | Butkiewicz et al. | |
| 7,695,357 | B2 | 4/2010 | Fleury et al. | |
| 2003/0067117 | A1* | 4/2003 | Hardie | 273/292 |
| 2004/0262841 | A1 | 12/2004 | Janney | |
| 2005/0006845 | A1 | 1/2005 | Hardie | |
| 2005/0051954 | A1 | 3/2005 | Scott et al. | |
| 2005/0153765 | A1 | 7/2005 | Shoostine | |
| 2005/0167918 | A1 | 8/2005 | Coster et al. | |
| 2005/0170873 | A1 | 8/2005 | Fishbach et al. | |
| 2005/0189716 | A1 | 9/2005 | Yu | |
| 2006/0119038 | A1 | 6/2006 | Crotteau | |
| 2006/0183540 | A1* | 8/2006 | Grauzer et al. | 463/29 |
| 2007/0108703 | A1 | 5/2007 | Ritter | |
| 2007/0296145 | A1* | 12/2007 | Storm | 273/138.2 |
| 2008/0113700 | A1 | 5/2008 | Czyzewski et al. | |
| 2009/0096159 | A1 | 4/2009 | Kenney et al. | |
| 2009/0309306 | A1 | 12/2009 | Bell et al. | |
| 2010/0044962 | A1 | 2/2010 | Ritter | |
| 2010/0105460 | A1 | 4/2010 | Makhoul et al. | |

FOREIGN PATENT DOCUMENTS

| | | | |
|---|---|---|---|
| DE | 102005029771 | A1 | 12/2006 |
| EP | 1302223 | A1 | 4/2003 |
| GB | 1377381 | | 12/1974 |
| GB | 2234183 | A | 1/1991 |

OTHER PUBLICATIONS

International Search Report dated Apr. 7, 2009 for International Application No. PCT/US2008/076413 International Filing Date Sep. 15, 2008.

Office Action issued by the German Patent and Trademark Office on Jan. 11, 2013.

English Translation of Office Action issued by the German Patent and Trademark Office on Jan. 11, 2013.

English Abstract for DE102005029771.

* cited by examiner

CARD GAME PLAYING DEVICE AND METHOD OF PLAYING A GAME

CROSS REFERENCE TO RELATED APPLICATION

This application claims the benefit of U.S. Provisional Patent Application Ser. No. 60/972,423 filed Sep. 14, 2007, the contents of which is incorporated herein by reference thereto.

BACKGROUND

Exemplary embodiments of the present invention relate generally to games and more particularly to card games in which players attempt to discard all of the cards in their hand to win the game. Various embodiments also relate generally to a device that can be used for playing a card game and methods of playing games using the device. The play of various card games is facilitated by one or more cards and the game playing device.

Examples of cards, card games, and devices for card games are disclosed in U.S. Pat. No. 5,114,153 entitled "Mechanical Card Dispenser and Method of Playing a Card Game," issued May 19, 1992, and in U.S. Patent Application Publication No. 2007/0108703A1, entitled "Card and Selection Device Games," published May 17, 2007, the disclosure of each of which is incorporated by reference herein in its entirety.

Conventional games exist in which players attempt to be the first one to dispose of all of their cards, or try not to be the last player still holding one or more cards when the other players do not have any cards. An example of such a game is the UNO® card game in which each player strives to be the first one to dispose of all of the cards from their hand. The playing cards from the UNO® card game are owned by Mattel, Inc. The UNO® card game involves a discard pile of cards, a draw pile of cards and cards that are dealt to each player. In the UNO® card game, a player not being able to match the upwardly facing card in a discard pile by number or by color, and not having a wild card, must draw cards from a draw pile until the player is able to make the required match or play a wild card.

SUMMARY

In one exemplary embodiment a method or methods of playing card games is disclosed. Other embodiments are directed to a device that can be used to play card games. In particular, one non-limiting embodiment is directed to a game playing device that can be used with cards to facilitate the playing of a card game. The game playing device is configured to be interacted with by the player in a game. The device includes an electronic system that utilizes several inputs to determine the play of a card game. Some of the inputs can relate to the quantity of players that want to play a game. Other inputs relate to a particular player's turn during a game. For example, a player may have a set period of time during which to play a card and if an appropriate input, such as the closing of a switch, is not received within the period of time, then the player is penalized. The electronic system also generates several outputs related to a game. The outputs can be visual and/or audible outputs. The outputs can be associated with a particular player of the game.

In one embodiment, a game playing device is provided. The game playing device having a housing with a card holding member, the card holding member being configured to receive a plurality of cards; a plurality of switches located on a surface of the housing each of the plurality of switches being capable of being illuminated; and a controller for selectively illuminating each of the plurality of switches, the illumination of at least one of the plurality of switches indicating a turn for playing the game playing device.

The advantages of the present invention will be understood more readily after a consideration of the drawings and the Detailed Description.

BRIEF DESCRIPTION OF THE DRAWINGS

Other features, advantages and details appear, by way of example only, in the following description of embodiments, the description referring to the drawings in which.

DETAILED DESCRIPTION

Figure 1:
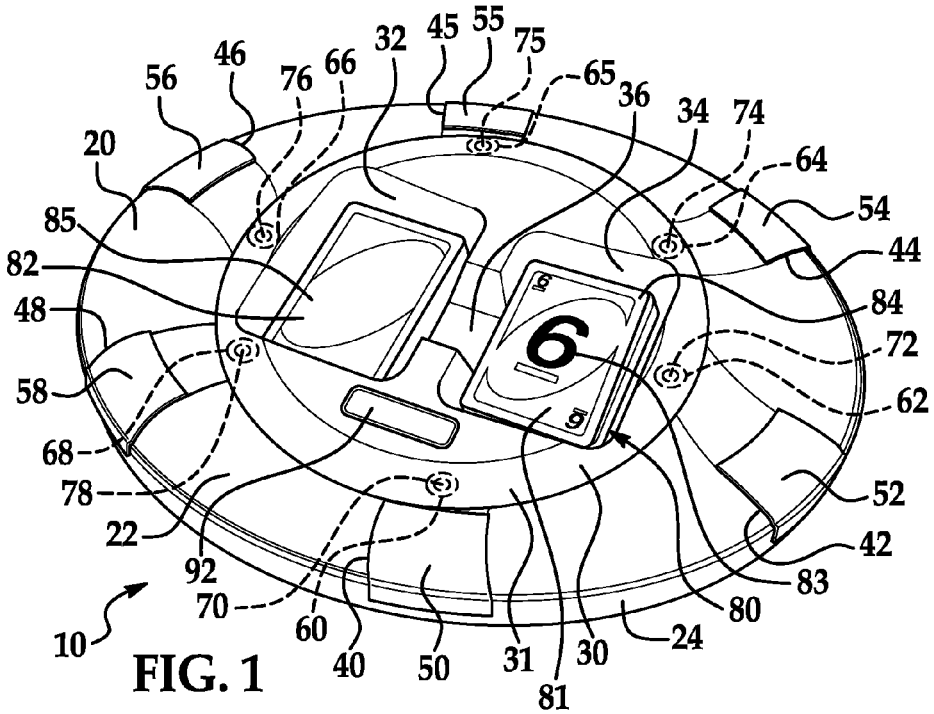
FIG. 1 is a perspective view of a non-limiting embodiment of the device according to the present invention.

Referring to now FIG. 1, a perspective view of an exemplary embodiment of a device according to the present invention is illustrated. The device 10 can be used with any type of playing cards. In one method of game play, a set of UNO® cards can be used with the device 10. Some of those cards are illustrated in FIG. 1 with the device 10.

In this embodiment, the device 10 includes a housing 20, which in this case is substantially circular, oval or oblong or of any configuration suitable for game play including rectangles etc. The housing 20 includes an upper portion 22 and a lower portion 24 that are coupled together using conventional fasteners, such as screws. Alternatively, the housing is molded as single housing having an upper portion and a lower portion. The dimensions and shape of the housing 20 are sufficiently large to allow multiple players to access and contact the housing 20 during game play. The upper portion 22 and the lower portion 24 are made of molded plastic. In other embodiments, the shape and/or configuration as well as the materials used for the housing 20 can vary.

Figure 2:
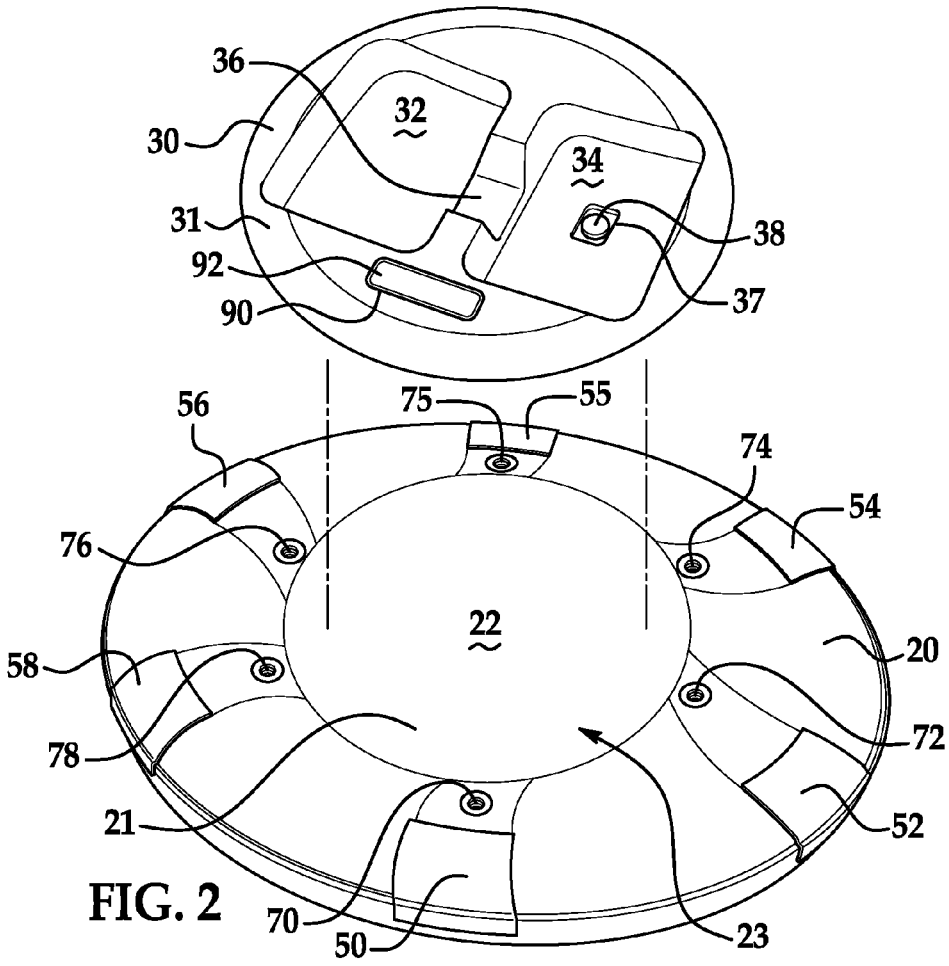
FIG. 2 is an exploded perspective view of the device illustrated in FIG. 1.

As shown in FIG. 2, the upper portion 22 of the housing 20 defines a central opening 21 that is in communication with the interior region 23 of the housing 20 that is defined by the upper portion 22 and the lower portion 24. As described in detail below, the device 10 includes an electronic system that can be disposed in the interior region of the housing 20 or in any portion of the housing thus being completely housed therein such that device 10 is a self contained unit.

The device 10 further includes a card playing or holding plate or support member 30 that is configured to be disposed on and coupled to the housing 20. In particular, the plate 30 covers the central opening 21 of the upper portion 22 and is configured to be used with playing cards 80. In another embodiment, the plate is integrally molded with the housing. In one embodiment, the card playing plate 30 includes an outer angled portion or periphery 31, card receiving receptacles 32 and 34, and a recess 36 between the receptacles 32 and 34. The card receptacles 32 and 34 are configured to receive playing cards 80 (see FIG. 1). In one method of game play, the card game may involve a draw pile 82 of cards 80 in which the cards are placed face down and from which players can select or draw one or more cards. In addition, the card game may involve a discard pile 84 of cards 80 in which players place cards from their hand of cards. The cards are typically oriented in a face-up manner in the discard pile 84. An exemplary set of cards that can be used with the device 10 are the UNO® playing cards.

The device 10 also includes a function button 92 that can be actuated during game play. Different or multiple functions/operations can be assigned to the button 92 and any switch that is associated with the button 92. Some exemplary uses of the button 92 are described below. In this embodiment, the button 92 is disposed in an opening 90 that is formed in plate 30. In other embodiments, the button 92 can be located at any location on the housing 20. Moreover, other additional buttons may be employed each of which provide similar or different functions or operations as will be discussed herein (See for example FIG. 4).

Referring to FIG. 1, other features of a non-limiting embodiment of the device 10 are now discussed. Here, the housing 20 also includes several game playing areas located around the perimeter or periphery of the housing 20. The game playing areas are configured so each player can access and utilize one of the game playing areas. The quantity of game playing areas used during a game can vary. As illustrated, there are six game playing areas located about the periphery of the device 10. In other embodiments, the quantity of game playing areas can vary (e.g., greater or less than six).

Now the elements that form a game playing area or location in one non-limiting exemplary embodiment will be described. The housing 20 includes a recess, opening or area 40 in which a button 50 is movably disposed, which an upper surface thereof is actuated by a player of the game. The button 50 is a molded plastic article that is biased outwardly/upwardly, but movable against the biasing mechanism, which can be a spring or any other equivalent biasing mechanism (not shown). In this embodiment, the button 50 is configured so that its outer surface is substantially similar to and aligned with the profile and configuration of the upper portion 22 of the housing 20. Of course, any other suitable configuration is contemplated to be within the scope of exemplary embodiments of the present invention. A switch (not illustrated in FIG. 1) is located beneath the button 50 and is configured to be engaged, manipulated or actuated when a player presses downwardly on the button 50 the switch may be any suitable switch type for providing an input to a controller of the game device. Accordingly, by pressing on the button 50, a user can provide an input to the device 10, which becomes part of the game play. In various embodiments, the button 50 can be any color and can have different shapes or configurations.

Located proximate to the game playing area with the button 50 is a hole or recess 60 and an output device 70. In this embodiment, the recess 60 is formed in the upper portion 22 of the housing 20 (see FIG. 2). The output device 70, disposed in the hole 60, can generate a visual output, such as light. In one embodiment, the output device 70 can be a light emitting device (LED). In other embodiments, the output device 70 can be a bulb or a lamp other than an LED. The button 50 and the output device 70 are associated together and collectively form a game playing area for a player. While the plate 30 can be made of a material that allows the output device 70 to be seen therethrough, an opening with a clear LED cover can be provided above output device 70 to allow it to be seen.

The other sets or combinations of buttons and output devices form additional game playing areas for the different players. The combination of button 52 (in recess 42) and output device 72 (in hole 62) form a game playing area. The combination of button 54 (in recess 44) and output device 74 (in hole 64) form another game playing area. The combination of button 55 (in recess 45) and output device 75 (in hole 65) form another game playing area. The combination of button 56 (in recess 46) and output device 76 (in hole 66) form another game playing area. The combination of button 58 (in recess 48) and output device 78 (in hole 68) form another game playing area. LED covers can be utilized with each of the output devices 72, 74, 75, 76, and 78. In this embodiment, the buttons 50, 52, 54, 55, 56, and 58 are substantially similar and the output devices 70, 72, 74, 75, 76, and 78 are substantially similar. In other embodiments, the buttons and/or the output devices can vary with respect to the other buttons and/or output devices. For example, devices 70, 72, 74, 75, 76, and 78 may be located anywhere on device 10 as the same may in one embodiment merely provide an ornamental feature or visual stimulation.

In other embodiments, the device 10 can include less than or more than six game playing areas. Accordingly, in those embodiments, more than six players or teams can play a game using the device 10 provided that a sufficient quantity of game playing areas exist. In addition, the location and configuration of the buttons 50, 52, 54, 55, 56, and 58 can vary and need not be associated with a recess having the shape or configuration as illustrated. Also, another light output device can be disposed beneath the buttons 50, 52, 54, 55, 56, and 58 so that when this particular light output device is illuminated, the button appears to be illuminated. In another embodiment, one or more light output devices (such as two or any amount of LEDs) can be located beneath a button, which can be clear, transparent or translucent to allow the light to be seen. When it is a player's turn, the LED or LEDs beneath a button can be illuminated. When the player's turn ends, the LEDs can be turned off, signaling the end of the period for play. Furthermore, illumination of the button can be used in various features of the game as will be discussed herein. In another embodiment, the button material can be textured or frosted.

Referring to FIG. 2, a perspective view of the card playing plate 30 is illustrated. Plate 30 includes an angled surface 31 and card receptacles 32 and 34. A recess 36 is provided to facilitate the engaging of cards in either receptacle 32 or 34 by a player. The portion of the plate 30 that defines the discard card receptacle 34 defines an opening 37 in its lower surface. A button or switch 38 is positioned proximate to the lower surface of the discard card receptacle 34 so that it projects from and extends upwardly from the opening 37. When a player places a card in the discard pile 84, the user can press downwardly slightly while placing the card. The downward pressure will actuate the button 38 and send a signal to the controller of the electronic system indicating that a card has been placed on the discard pile. The size and shape of the opening 37 and the button 38 can vary. Furthermore, the configuration of the plate may also vary (e.g., no angled surface 31 or other variations, etc.).

Figure 3:
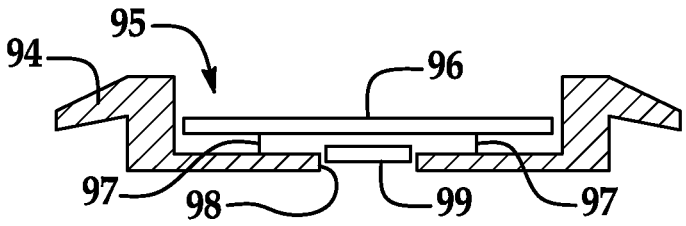
FIG. 3 is a cross-sectional view of a portion of a plate of an alternative embodiment of a device according to the present invention.

Referring to FIG. 3, a portion of an alternative embodiment of a plate of a game playing device is illustrated. In this embodiment, the plate 94 includes a discard pile receptacle 95 in which cards that are discarded during game play can be placed. A movably mounted plate 96 can be positioned in the receptacle 95 and even biased upwardly slightly by one or more biasing mechanisms 97, such as springs. When the plate 96 is moved downwardly, it engages a button 99 that is disposed in an opening 98. When the button 99 is engaged, a signal is generated and sent to the electronic system of the device indicating that a card has been placed on the discard pile.

Figure 4:
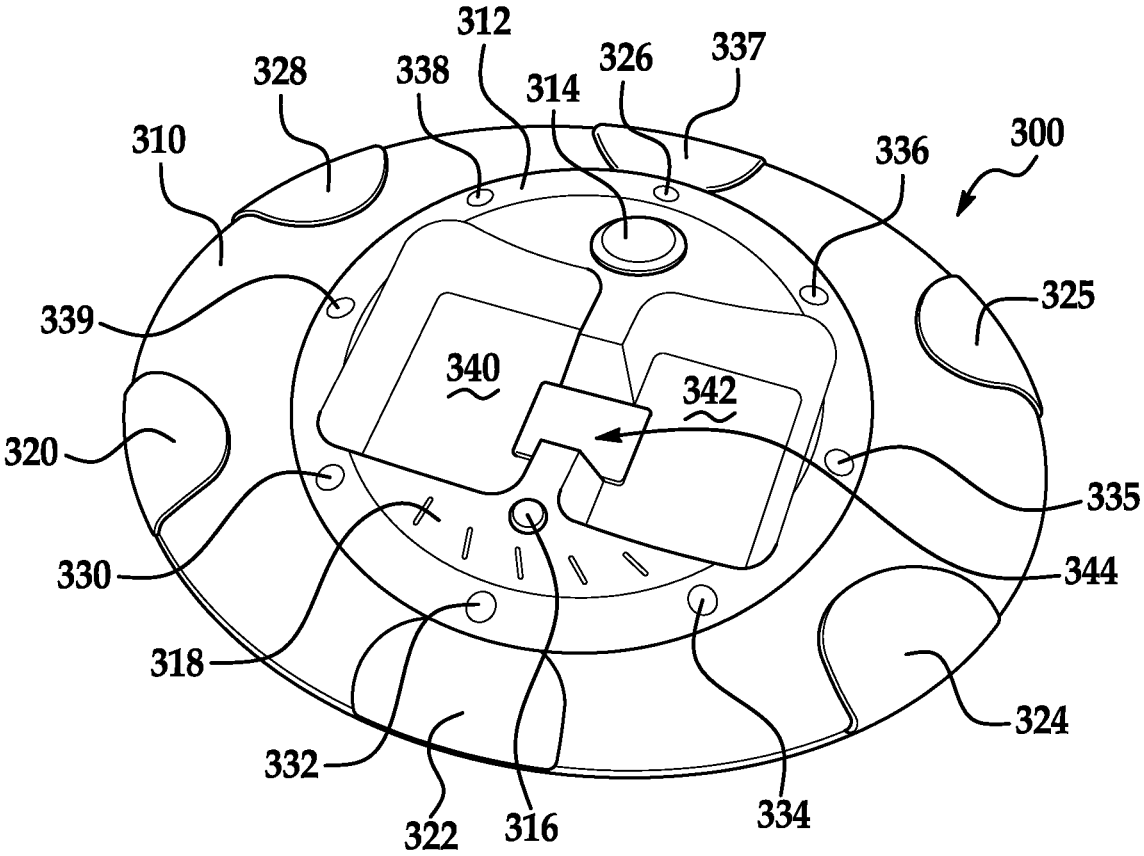
FIG. 4 is a perspective view of another embodiment of the device according to the present invention.

An alternative embodiment of a game device according to an exemplary embodiment of the present invention is illustrated in FIG. 4. In this embodiment, the game device 300 includes a housing 310 and a card plate 312 supported thereon or coupled thereto. In general, game device 300 includes many similar features and components as previously described game device 10. Game device 300 includes several spaced apart buttons 320, 322, 324, 325, 326, and 328 that can be used by players or teams and can be illuminated during game play. The housing 310 includes several light output devices 330, 332, 334, 335, 336, 337, 338, and 339 that can be illuminated or sequenced on and off during the game. The card plate 312 includes two card receptacles 340 and 342 and a recess 344 disposed between them. In one embodiment, the card plate may be integrally formed with the housing. A switch or sensor can be provided with one of the card receptacles 340 and 342 to sense or detect when a card has been discarded. Alternatively, no switch is provided in the receptacles and actuation of depressing of the player's button indicates a card has been played. The game device 300 also includes a function button 314 (which in one embodiment can include the name UNO® thereon) that can be actuated by the players or teams to initialize game play. The game device 300 also includes another button 316 which can be used by a player or a team during the game to indicate that an action card, such as a "Slap" Card, as described in detail below, has been played. Alternatively, the operations of buttons 314 and 316 may be reversed (e.g., the larger button is used with special cards (Slap cards) and the smaller button is the function button). Of course, other configurations are contemplated to be used in accordance with exemplary embodiments of the present invention. The card plate also includes several openings 318 through which audible outputs may be heard. Alternatively, speaker openings may be disposed on a lower surface of the housing. The housing, the buttons and the card plate can be made of plastic or in other embodiments, any material that provides sufficient strength.

Figure 5:
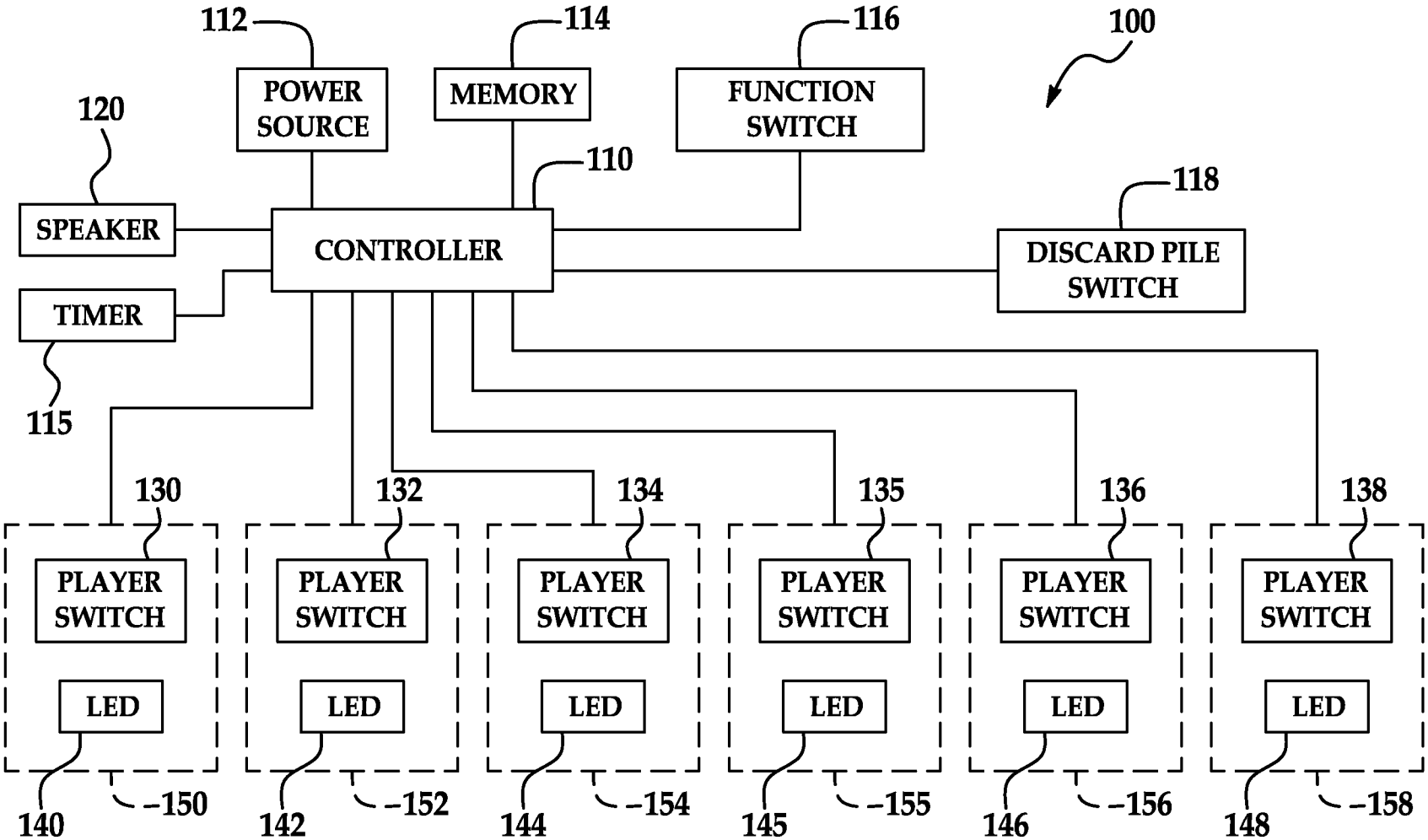
FIGS. 5-5A are functional block diagrams illustrating portions of a device according to various embodiments of the present invention.
Figure 5A:
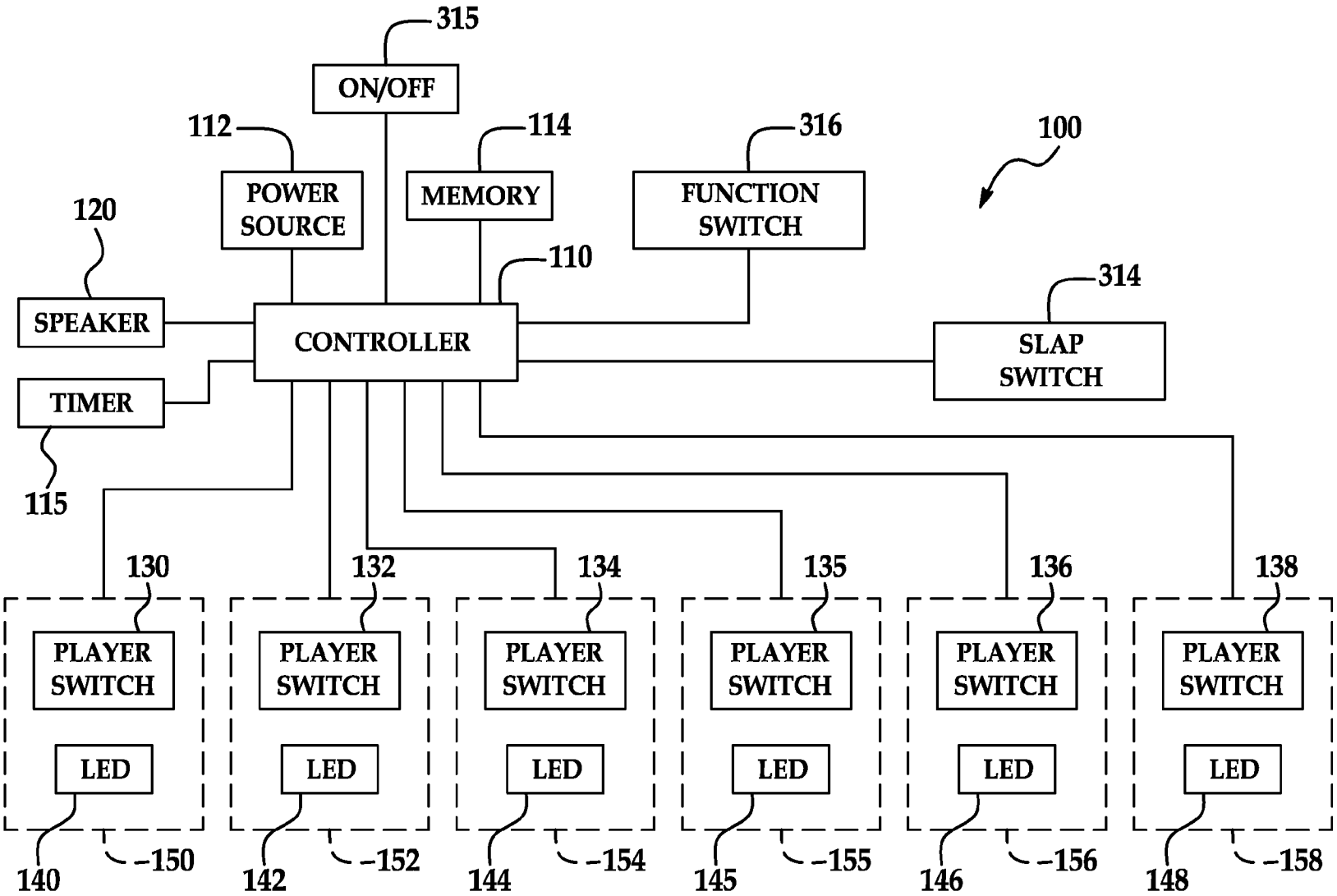

Exemplary embodiments of game playing devices according to the invention are illustrated in FIGS. 5 and 5A. In this embodiment, portions of the game playing device are illustrated schematically as 100, the game playing device includes a controller 110 that is connected to a power source 112 and a memory 114. The electrical components of the device 100, including the controller, function for the operation of the device. The electrical system includes software and programming components or elements that run on conventional electrical components. The power source 112 can be any type of power source, including batteries, cells, etc. The device 100 includes an audible output device 120, such as a speaker, through which speech and/or sound effects can be heard. Also, the device 100 may include a timer or timing mechanism 115 which can be used during game play to define a period during which a player must take an action. The function of the timer or timing mechanism can be performed by the controller as well.

Figure 6:
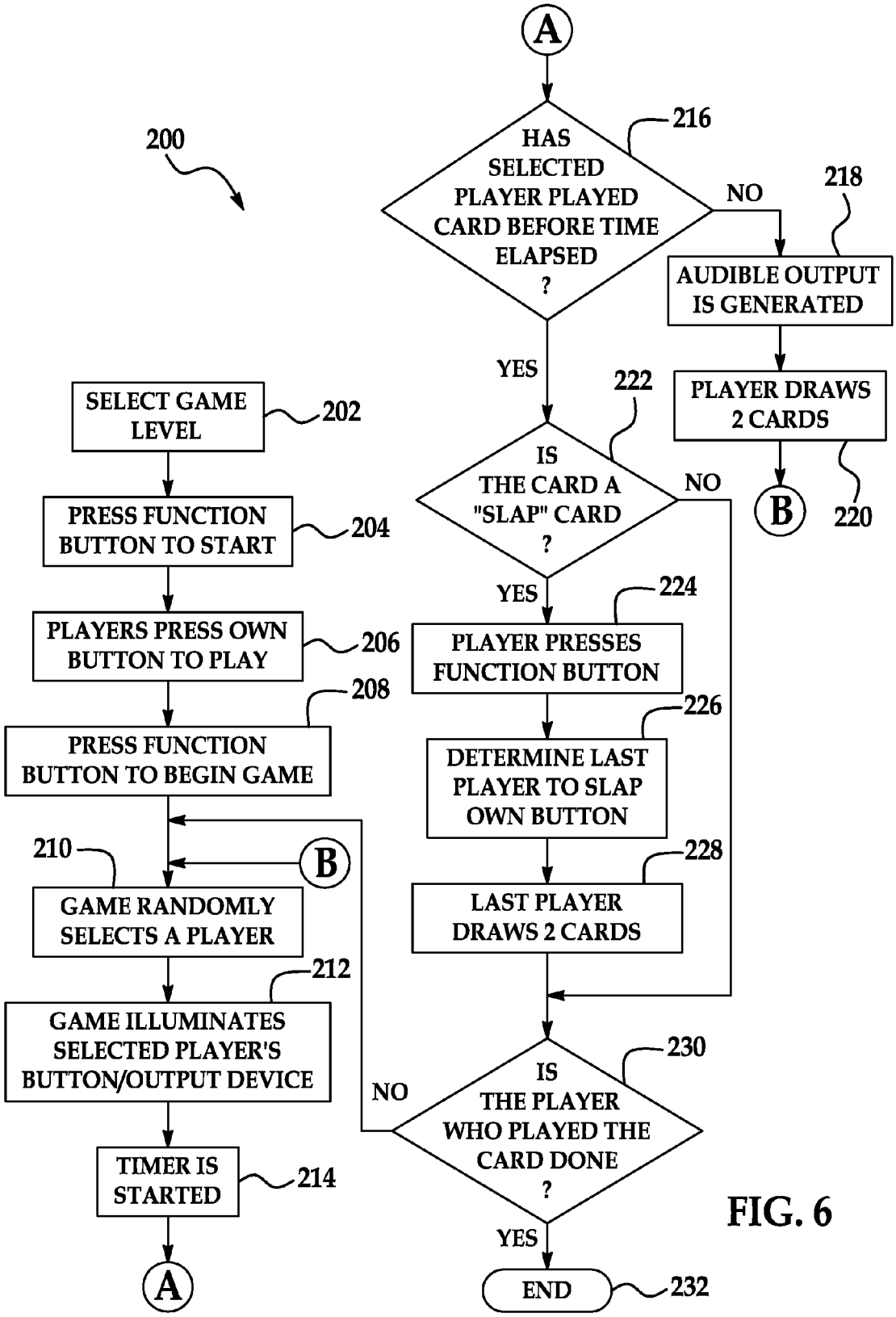
FIG. 6 illustrates a flowchart showing some steps of a method of playing a game using the device illustrated in FIG. 1 in accordance with an exemplary embodiment of the present invention.

In one non-limiting embodiment and referring now to FIG. 6, a control algorithm is illustrated, the algorithm is resident upon a microprocessor of a controller or microcontroller or controller or other equivalent processing device capable of executing commands of computer readable data or program for executing a control algorithm that controls the operation of the device. In order to perform the prescribed functions and desired processing, as well as the computations therefore (e.g., the execution of fourier analysis algorithm(s), the control processes prescribed herein, and the like), the controller may include, but not be limited to, a processor(s), computer(s), memory, storage, register(s), timing, interrupt(s), communication interfaces, and input/output signal interfaces, as well as combinations comprising at least one of the foregoing. For example, the controller may include input signal filtering to enable accurate sampling and conversion or acquisitions of such signals from communications interfaces. As described above, exemplary embodiments of the present invention can be implemented through computer-implemented processes and apparatuses for practicing those processes.

Referring back now to FIG. 5, the game playing device 100 includes several devices by which inputs can be provided to the device 100. In particular, the device 100 includes a function switch 116 that can be actuated by users before, during or after game play. In one embodiment function switch receives an input from any one of switches or buttons 92, 314 and 316. In one non-limiting embodiment, the device 100 also includes a discard pile switch 118 that can be actuated when a player places a card in the discard pile during a game. The discard pile switch 118 can correspond to switch or button 38 that is illustrated in FIG. 2. Alternatively, the device is constructed without a discard switch and the individual player switches are activated when a card is placed in the discard pile. See for example the device illustrated in FIG. 4 without a discard pile switch. Here, actuation of switches 130-138 by buttons 50-58 or 320-328 indicate that a card has been discarded and switch 118 is not necessary. Thus, switches 130-138 provide multiple inputs to the controller in accordance with various embodiments of the present invention. In still another embodiment a separate slap switch 314 is provided to be directly coupled to controller 110 (e.g., slap switch 314 is actuated by button 314). FIG. 5A illustrates a device wherein separate switches are provided and no discard switches are provided in the card holding area as switches 130-138 are also used as discard switches when they are actuated by player buttons 50-58 or 320-328. Also illustrated in FIG. 5A is a separate on/off switch 315. Switch 315 could also provide other selections such as game type (e.g., timer or no timer or time speed for each player's turn).

Also illustrated in FIGS. 5 and 5A are some of the elements of game playing areas 150, 152, 154, 155, 156, and 158. Area 150 includes a player switch 130 that can be proximate to and actuated by a button (such as buttons 50-58 or 320-328 as described above). Area 150 also includes an output device 140. In one embodiment, the output device 140 can be an LED or other visual output device, which illuminates the player button as described herein. Areas 152, 154, 155, 156, and 158 include player switches 132, 134, 135, 136, and 138 and LEDs 142, 144, 145, 146, and 148, respectively. While six game playing areas are shown, any number can be provided. Also, other input device (including switches or buttons) with different functions can be provided.

Illustrative examples of a use of the game device or method 200 of playing a game are described with reference to FIG. 6. In different uses of the game device, various combinations of all or some of the illustrated steps described herein may be performed however, different game playing devices can be used with the steps or actions described below. Software and/or programming components collectively function in the game device to allow for the usage of the game device, and in particular, for the sequencing of player turns, the illumination of any light output device, the generation of audible outputs, the sensing of the placement of a card on the discard pile, and the operation of the buttons on the game device. The steps and action described below are exemplary usages of the game device that are facilitated by the electrical components of the game device, including the software and programming.

Initially, cards from a deck of playing cards are dealt to the players participating in the game. After the cards have been dealt or before they are dealt, a player may select the level at which the game is to be played (see step 202). The game level selection can be made by a player using a switch on the housing (e.g., below or on top of the housing). A player can press the function button 92 to start the initialization process (see step 204). Here function button 92 can actuate function switch 116 and provide an input to the controller or alternatively, function button 92 can be directly connected to the controller or a plurality of buttons may be directly connected to the controller as illustrated in FIG. 5A (e.g., each of the buttons includes a switch to provide an input to the controller when they are actuated). Next, each player participating in the game presses the button associated with that player's game playing area at step 206. For a game using the device, the players press their corresponding button out of the set of buttons 50, 52, 54, 55, 56, and 58 or buttons 320-328. The electronic system of the device 10 registers the inputs using the buttons and determines which game playing areas to activate for a game. Here each of the buttons may illuminate indicating an area has been selected by a player (e.g., non-selection of a button will remove that button from the game). After the players have entered their desire to participate, a player presses the function button 92 or button 316 to begin the game (see step 208). Alternatively, the game can start after a predetermined amount of time without the re-pressing of the button 92 or button 316. In the FIG. 4 embodiment, button 316 is the function button and button 314 is the Slap button.

Once the function button has been selected and at step 210, the device 10 (which includes the electrical components that control game play) randomly selects one of the participating players (by selecting a game playing area with which to begin the game). The device 10 illuminates the selected player's output device and/or button at step 212. The selection or illumination of the button indicates that it is the selected player's turn to play a card on the discard pile. Simultaneously or soon thereafter, a timer or timing mechanism of the electronic system is activated at step 214 at the start of the selected player's turn to define the period during which the selected player must play a card. In one embodiment, the timer may determine a fixed period of time, such as four seconds or six seconds (e.g., selected by a switch in the housing). Alternatively, the timer may be adjustable by the user so that the determined period of time may vary. In another method of game play, the timer may be turned off so that the players have an unlimited amount of time for their turns.

At step 216, the controller determines whether the selected player has played a card before the time for the player's turn has elapsed. As previously discussed, one implementation of determining whether a player has played a card is by using a button or switch at the bottom of the discard card pile receptacle. When a player places a card on the discard pile, the player can press downwardly either as the card is placed on the discard pile or just after the playing of the card to actuate the switch beneath the discard card pile. In other embodiments, different sensors can be used to determine when a card has been placed in the discard pile. For example, infrared (IR) or other light sensors can be used to sense the placement of a card as well as proximity or motion sensors. In another embodiment, a piezoelectric sensor can be used to sense or detect the placement of a card. In still another embodiment the subsequent depressing of the illuminated player button indicates that a card has been discarded in the predetermined period of time (e.g., depression of the player's button replaces depression of a switch below the discard pile).

During the predetermined time period the device will provide visual and/or audio feedback such as illuminating lights (e.g., LEDs or output devices 70, 72, 74, 76, 78 or the player's buttons) and sounds. In one non-limiting embodiment, the sounds may resemble a ticking sound and/or the lights may be illuminated in a sequential fashion (e.g., circling around the device). Alternatively, the device may be configured to operate without a timing device and each player will have as long as they want to discard a card.

At step 216, if a card was not played by the selected player prior to the elapsing of the time period, then an output is generated at step 218. The output can be an audible output of speech and/or sound effects that is indicative of the end of the time period, such as a buzzer or horn or speech such as "too late" or the flashing of that player's button. The result of not playing a card in time is that the player has to take two cards from the draw pile and place them in their hand (see step 220). In different methods of game play, there may be various penalties for a player that does not play a card during the time for their turn. For example, a player may have to draw a quantity of cards other than two. Alternatively, the player may have to skip the player's next turn.

At this point, the game will once again randomly select one of players who is then the next player to play (see step 210). The selected player can be the same player who just had a turn or a different player in the game. In other game play embodiments, the game may select the player adjacent to the previously player and subsequently proceed around the device 10 in a non-random manner. In one embodiment and in order to resume game play after a player has not provided an input during the predetermined time period or in the event a player cannot play a card either during timed play or un-timed play, the function button 92 or button 316 is depressed and the game continues on wherein a selected player's button or light switch is once again illuminated indicating that is that player's turn. In other words, depression of button 92 or 316 after a player's turn causes the controller to randomly select another player by illuminating their button. This will continue until there is a winner (e.g., a player who has discarded all of their cards). Moreover, the random selection allows for intrigue in the game as nobody's knows whose turn is next and in some instances the same player is selected twice.

Returning to step 216, if the selected player played or discarded a card before the time period elapsed, the game play continues to step 222. In this embodiment, the game play is based on the use of UNO® playing cards and in particular a deck of UNO® playing cards having special feature cards of course, numerous variations are contemplated. As will be discussed herein the UNO® playing card deck or set will include one or more types of action cards. In accordance with an exemplary embodiment of the present invention there are action cards that include involvement and interaction with the game playing device. One such type of action card that is included in the deck of cards used with the game device in various embodiments of the present invention is a "Slap" card. When a "Slap" card is played by one player, the other players must provide an input, such as a slap or a hit (sometimes in a designated area), and the last player to do so is penalized. A typical penalty may be that the last player to slap must draw a card from the draw pile. Thus, if the card played by the selected player is a "Slap" card, then the selected player presses the function button 92 or button 314 (e.g., Slap Button, step 224) after playing the slap card instead of their associated button. The game play is such that when the electronic system or controller determines that the discard pile switch is actuated and subsequently the function button 90 or 314 is actuated prior to the selection of another player for a turn, then the card that has been played has been a "Slap" card. Alternatively and referring to the device of the FIG. 4 and FIG. 5A embodiment and when a player decides to play a Slap card after their button is randomly selected and illuminated by the controller, that player discards the Slap card and merely presses the Slap button 314.

Therefore, when a "Slap" card is played by a player, each of the other players must contact or press the button or switch in their respective game playing area as quickly as possible. The controller determines which player is either the last player to press his or her button or the only player that does not press his or her button (see step 226). An indication of the last player may be made by illuminating the button or LED associated with that player's game playing area or the generation of an audible output, such as "Player 2" or "Player 2 is last" or a buzzing sound and/or flashing of that player's light will occur. The last player is penalized and draws two cards from the draw pile (see step 228) or encounters a different penalty associated with being last. In one embodiment, when a player who has been selected by the controller (e.g., their button is illuminated by the controller) pushes the Slap Button (92 or 314) their button remains illuminated and all of the other player's buttons must be slapped or depressed and in some embodiments illuminated. Once the second to last player's button is depressed and illuminated the last player is determined by the controller. Here a buzzer may sound and/or the last player's light will flash indicating the loser or that slap round.

As a penalty, the last player to slap their button draws two cards from the draw pile (step 228) or if the card played was not a "Slap" card (step 222), the game then proceeds (e.g., by depressing the function button 92 or button 316 in order to randomly select the next player's turn and to continue play in order to ultimately have a winner (e.g., the player who has no more cards, see step 230). If the player who played the card still has cards in his or her hand, then the game continues and another player is selected for a turn at step 210. If the player has one card remaining in his or her hand, the player announces "Uno". In this exemplary use of the game device, the game continues as previously described. However, if the player is out of cards, the player announces that he or she is out of cards and then the game ends (see step 232).

As described above and in an exemplary embodiment (See FIG. 4), and when the player plays a slap card the player merely actuates button 90 or 314 and that player's button illuminates and thereafter each other player must immediately illuminate their button by depressing it and the last to depress their button is considered the loser and must pick up cards or have some other penalty. Thereafter and in order to continue the game the button 90 or button 316 is depressed and the game continues on as previously discussed.

As previously described, an exemplary set of cards that can be used with the game devices described herein are the UNO® playing cards. Various descriptions of such exemplary cards are set forth in U.S. Patent Application Publication No. 2007/0108703, the contents of which has been incorporated herein by reference thereto here and in accordance with an exemplary embodiment of the present invention random selection of the next player is determined by the controller.

Referring now to FIGS. 1-6, the number of game cards 80 may vary depending upon the particular rules of the game. In one non-limiting embodiment, the game cards 80 will have at least one surface which can accommodate the placement thereon of a first identifier 81 and a second identifier 83 either one of which may be a common identifier. The identifiers 81, 83 are affixed to one side of the card through printing, painting, molding, through the use of an adhesive backed appliqué or any other suitable method for permanently applying the identifiers to the game cards 80 while an opposite side of the card has a non-descript decorative indicia 85 applied thereto such that all of the cards look the same on one side. In one non-limiting exemplary embodiment, the first identifier is a color (e.g., red, blue, yellow, green, or any color) and the second identifier is a number, character, symbol etc. Of course, any type of recognizable indicia or shape may be used as the first identifier and the second identifier. In one exemplary embodiment and referring in particular to the slap cards, the second identifier is a character associated with the slap card (e.g., a picture of a hand or palm or any other character) and the first identifier is a color. Further and in one non-limiting embodiment, the deck may include a plurality slap cards (e.g., a few for each color of the cards in the deck) thus, the slap cards can be played or discarded when either they match the color of the last card displayed or discarded or if a previous slap card has been played. In still another alternative, the slap card may be a wild card wherein it can be played at any time and the player playing the slap card can call out the new color or the color of the slap card can be used.

The game cards may comprise a plurality of sub-sets with each sub-set including game cards having at least a first identifier 81 and a common (i.e. to the subset) identifier 83. Each first identifier in a sub-set is common with at least one other first identifier of another subset. In addition, special game cards, such as "SLAP" cards are also included in the game with each special game card having a particular use during game play (e.g., involving the use button 314 to subsequently require each other player to illuminate or strike their button or switch). Of course, other types of game cards are contemplated for use with the exemplary embodiments of the present invention.

One non-limiting example of game play with UNO® cards will now be described below: first each player will be assigned a button or switch (e.g., by pressing their button during a game prompt as the beginning of the game) and then the deck of cards is shuffled and a predetermined amount of cards are dealt to each player. After that, the remaining cards are placed in a central location of the device. The remaining cards provide a draw pile 82 and one card from the draw pile is turned face up as a displayed game card (shown as 6 in FIG. 4) so that the first and common identifiers of that card are visible.

A first player (whose switch or button was randomly illuminated by the controller) observes the displayed game card and compares the identifiers 81, 83 of the card with those drawn earlier by him or her. If either of the identifiers 81, 83 of the displayed game card matches an identifier of a game card in this player's collection of previously drawn cards, the player hits their button, stops the timer of the controller and discards his or her matching game card, which now becomes the displayed game card. Thereafter, the function button 92 or 316 is depressed and a next player's turn is randomly selected by the controller and that player's button is illuminated. If a matching card is not in the second player's collection of previously drawn cards or the player fails to make a play in a predetermined period of time, the player must take at least one other card from the draw pile and the drawn card is added to that player's hand and the next player is selected by the device. In one embodiment, a buzzer and/or flashing lights will occur indicating the play has not been made in the predetermined time period. For example, if the displayed game card is a "blue 6" the next player may play any blue card or any card with the number 6 regardless of color. In addition, they may play a wild Card or a Wild Card+4 or the Slap Card (e.g., the wild cards or Slap Cards can in one embodiment be played at anytime).

In either case, a new card is displayed or the previous card stays displayed and the next player (selected by the device e.g., controller) must match the displayed card (e.g., old or new). Again, the new player is selected randomly when the function button 92 or 316 is depressed. The object of the game is to be the first player to discard all of their cards. As discussed herein one exemplary format for playing or a set of rules for playing this game is similar to that of UNO®. Another example format would be that of a class of games referred to a "shedding games" in which the overall object of the game is to be the first player to return or discard all of his or her cards. Of course, other card games are contemplated to be used in accordance with exemplary embodiments of the present invention.

Depending on the particular game rules, special game cards may allow a player to take particular actions which are not described above. For example, the special game cards are played as wild cards or trump pieces which allows them to match any displayed card and also allows the user to pick or choose the next identifier (e.g., color and/or character). Thus, these special game cards may be more valuable than other game cards. It is also understood that more than one special game card can be in the plurality of game cards and the different special game cards can be provided.

The use of the "Slap" card in the description of the game play method above is intended to be exemplary of any type of action card that can be used with the game device. In other words, cards that require players to take an action in addition to and/or other than a "slapping" action can be used during a game. The game play device provides the ability to use various action cards that require players to take an action. The various game playing areas of the device are configured to determine the last player to take an action set forth on or required by a card. In other words, the buttons in the game playing areas can be contacted by players after performing other actions required during the game. Also, cards other than UNO® playing cards can be used with the game playing device.

This disclosure may include one or more independent or interdependent inventions directed to various combinations of features, functions, elements and/or properties. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application. No invention described herein necessarily encompasses all features or combinations described. Where "a" or "a first" element or the equivalent thereof is recited, such includes one or more such elements, neither requiring nor excluding two or more such elements. Further, indicators, such as first, second or third or upper or lower, for identified elements are used to distinguish between the elements, and do not indicate a required or limited number of such elements, and do not indicate a particular position or order of such elements unless otherwise specifically stated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A game playing device comprising:

a housing having a card holding member, the card holding member being configured to receive a plurality of cards, wherein the plurality of cards includes at least one slap card;

a plurality of switches located on a surface of the housing each of the plurality of switches being capable of being illuminated;

a controller for selectively illuminating each of the plurality of switches, the illumination of at least one of the plurality of switches being randomly selected by the controller and the illumination thereof indicating a turn for playing the game playing device, wherein the turn includes an act of placing at least one of the plurality of cards in the card holding member or drawing a card from the plurality of cards;

a function button, the function button providing a function input to the controller for starting and stopping a game being played with the game playing device;

a slap button, wherein the slap button is depressed when the at least one slap card is placed in the card holding member and one of the plurality of switches is illuminated and the depression of the slap button causes the one of the plurality of switches to remain illuminated and thereafter each of the remaining plurality of switches are illuminated when depressed and the controller determines which one of the plurality of switches is the last one to be depressed, and wherein the controller causes still another output to be provided, the still another output indicating which one of the plurality of switches was the last one of the plurality of switches to be depressed after actuation of the slap button.

2. The game playing device as in claim 1, further comprising a timing device for determining a predetermined time period for which an actuation input is to be provided to the controller when one of the plurality of switches is illuminated by the controller, wherein the actuation input is actuation of the one of the plurality of switches that is illuminated by the controller.

3. The game playing device as in claim 2, wherein the game playing device further comprises a plurality of lights illuminated during the predetermined time period.

4. The game playing device as in claim 3, wherein the plurality of lights are illuminated in a sequential fashion.

5. The game playing device as in claim 1, further comprising a timing device for determining a predetermined time period for which an actuation input is to be provided to the controller when one of the plurality of switches is selectively illuminated by the controller, wherein the actuation input is actuation of the one of the plurality of switches that is illuminated by the controller.

6. The game playing device as in claim 5, wherein the controller selectively illuminates a second one of the plurality of switches indicating a second turn for playing the game playing device and the timing device determines a second predetermined time period for which a second actuation input is to be provided to the controller when the second one of the plurality of switches is illuminated by the controller and wherein the second actuation input is actuation of the second one of the plurality of switches that is illuminated by the controller.

7. The game playing device as in claim 5, wherein the plurality of switches are disposed on the periphery of the game playing device in a spaced manner and wherein the still another output is provided by the controller when only one of the remaining plurality of switches is not depressed after actuation of the slap button.

8. The game playing device as in claim 1, wherein the still another output is anyone of: an audio output; a visual output; and a combination of an audio and visual output.

9. The game playing device as in claim 8, wherein the card holding member is configured to have a pair of card holding areas including one for a first plurality of cards and another for a second plurality cards.

10. The game playing device as in claim 9, further comprising a timing device for determining a predetermined time period for which an input is to be provided to the controller when one of the plurality of switches is illuminated by the controller.

11. The game playing device as in claim 8, further comprising a speaker operated by the controller.

12. The game playing device as in claim 8, wherein the plurality of switches are disposed on the periphery of the game playing device in a spaced manner and wherein the still another output is provided by the controller when only one of the remaining plurality of switches is not depressed after actuation of the slap button.

13. The game playing device as in claim 1, wherein the plurality of game cards further comprise:

a plurality of sub-sets, the game cards in each subset having a common identifier and a first identifier, each first identifier being common with at least one first identifier of another sub-set.

14. The game playing device as in claim 13, wherein the first identifier is color and the common identifier is numerical value.

15. The game playing device as in claim 1, wherein an actuatable switch is located on a bottom surface of the card holding member and actuation of the actuatable switch sends a signal to the controller indicating that one of the plurality of cards has been placed into the card holding member.

16. The game playing device as in claim 1, wherein the card holding member is configured to provide a pair of card receiving receptacles and wherein one of the card receiving receptacles has an actuatable switch located proximate to a bottom surface of the card receiving receptacle and actuation of the actuatable switch sends a signal to the controller indicating that one of the plurality of cards has been placed into the card receiving receptacle.

17. The game playing device as in claim 1, wherein the still another output is provided by the controller when only one of the remaining plurality of switches is not depressed after actuation of the slap button.

18. The game playing device as in claim 1, wherein the still another output indicates a loser of the turn of the game playing device.

* * * * *